US007074499B2

(12) United States Patent
Schnurer et al.

(10) Patent No.: US 7,074,499 B2
(45) Date of Patent: Jul. 11, 2006

(54) POLYMERIC FIBER COMPOSITION AND METHOD

(75) Inventors: John H. Schnurer, Yellow Springs, OH (US); Robert Michael Klein, Los Angeles, CA (US); David Dru Horinek, Camarillo, CA (US)

(73) Assignee: Holofiber, LLC, Los Angeles, CA (US)

( * ) Notice: Subject to any disclaimer, the term of this patent is extended or adjusted under 35 U.S.C. 154(b) by 0 days.

(21) Appl. No.: 10/396,131

(22) Filed: Mar. 24, 2003

(65) Prior Publication Data

US 2004/0043209 A1 Mar. 4, 2004

Related U.S. Application Data

(60) Provisional application No. 60/366,237, filed on Mar. 22, 2002.

(51) Int. Cl.
*B32B 9/00* (2006.01)

(52) U.S. Cl. ..... 428/690; 428/359; 428/364; 428/297.4; 428/397; 428/332; 428/402; 428/401; 442/417

(58) Field of Classification Search ..... 428/690, 428/359, 364, 297.4, 397, 401, 323, 332, 428/417

See application file for complete search history.

(56) References Cited

U.S. PATENT DOCUMENTS

| | | | | |
|---|---|---|---|---|
| 4,211,813 | A | 7/1980 | Gravisse et al. | 442/76 |
| 5,466,526 | A | 11/1995 | Magata | |
| 5,779,950 | A | 7/1998 | Kang | |
| 5,851,668 | A * | 12/1998 | Sandor et al. | 428/397 |
| 6,034,010 | A * | 3/2000 | Cartwright et al. | 442/417 |
| 6,126,879 | A * | 10/2000 | Sandor et al. | 264/177.2 |
| 6,210,798 | B1 * | 4/2001 | Sandor et al. | 428/364 |
| 6,332,993 | B1 | 12/2001 | Jen | 264/103 |
| 6,599,444 | B1 * | 7/2003 | Burnell-Jones | 252/301.36 |
| 2002/0035755 | A1 | 3/2002 | Widdemer | |

FOREIGN PATENT DOCUMENTS

| | | |
|---|---|---|
| EP | 0 462 275 A1 | 12/1991 |
| EP | 1 291 405 A1 | 11/2001 |

OTHER PUBLICATIONS

"*Breakthrough Double Blind Clinical Study Proves Holofiber Claims to be Compelling and Significant,*" XP-002248567, Release: Jan. 31, 2003 (4 pp).

* cited by examiner

*Primary Examiner*—Merrick Dixon
(74) *Attorney, Agent, or Firm*—Morrison & Foerster LLP

(57) ABSTRACT

The present invention generally relates to specific combinations of active particles, forming a powder, that may be combined with carrier materials such as resins to produce fibers for textiles, films, coatings, and/or protective or insulating materials. The specific mixture of particles and materials may be carefully engineered to impart unique and valuable properties to end products including integration with optical energies, heat, and other electromagnetic energies. Resultant compositions may interact with light in the visible spectrum and optical and electromagnetic energy beyond the visible spectrum.

28 Claims, No Drawings

POLYMERIC FIBER COMPOSITION AND METHOD

CROSS REFERENCE TO RELATED APPLICATIONS

This application claims the priority of United States provisional patent application Ser. No. 60/366,237 filed Mar. 22, 2002, and is related to U.S. application Ser. No. 10/396,132, filed on Mar. 24, 2003.

FIELD OF THE INVENTION

The present invention generally relates to specific combinations of active particles, forming a powder, that may be combined with carrier materials such as resins to produce fibers for textiles, films, coatings, and/or protective or insulating materials. The specific mixture of particles and materials may be engineered to impart unique and valuable properties to end products, including integration with optical energies, heat, and other electromagnetic energies. Resultant compositions may interact with light in the visible spectrum, as well as optical and electromagnetic energy beyond the visible spectrum.

The powder may be added to a carrier material, such as, for example, a polymer, which may then be extruded to form a fiber or formed into a membrane, or film, which may be used to create a fabric or coating useful in a variety of applications. Such applications may include hosiery, footwear, active wear, sports wear, sports wraps, base layer, gloves, and bandages. These items may also have certain properties such as controlling odor, regulating heat, providing protection from fire, providing protection from harmful light, insulation, wound healing, and preserving food. The powder may be designed to interact in a benign manner with the human body, its needs, requirements, and homeostatic stabilization.

BACKGROUND OF THE INVENTION

Human bodies, as well as other organisms and substances, produce electromagnetic radiation in the form of, for example, heat or infrared radiation. In certain circumstances it may be desirable to retain this radiation, such as, for example, applications in which maintaining body heat or food temperature is desired. For example, once a food product is cooked, it may reach a certain temperature; however, this heat is often lost by exposure to cooler temperatures such as ambient air. In another example, a human body may be exposed to cooler temperatures, and infrared radiation may be lost through the epidermis. Retaining this infrared radiation, may have certain beneficial properties including maintaining a particular temperature, evading detection by infrared sensors, insulating pipes and other construction materials to prevent heat transfer, and providing heat to prevent joint stiffness. Known fibers do not completely solve the escape of radiation from a heat-emitting object, without also creating moisture or other undesirable side effects.

SUMMARY OF THE INVENTION

This invention seeks to correct the problems and meet the needs of the industry as detailed above. Therefore, it is a specific objective of the present invention to provide methods and compositions that will provide a biologically benign composition that is optically responsive.

One embodiment of the invention relates to a composition comprising titanium dioxide, quartz, aluminum oxide, and a resin. The resin composition is a polymer. The aluminum oxide, titanium dioxide, and quartz may be dispersed within the resin. In addition, the titanium dioxide, quartz, and aluminum oxide may be present in a dry weight ratio of 10:10:2, respectively. In this embodiment, the titanium dioxide, quartz, and aluminum oxide may comprise about 1 to about 2 percent of the total weight of the composition, and the composition may be biologically benign.

In another embodiment of the present invention, the titanium dioxide within the composition may comprise an average grain size of about 2.0 microns or less and the grains may be substantially triangular. The aluminum oxide within the composition may comprise an average grain size of about 1.4 microns or less and the grains may be scalloped-shaped. Additionally, the quartz within the composition may comprise an average grain size of about 1.5 microns or less and the grains may be rounded in shape. The titanium dioxide, aluminum oxide, and quartz composition may be homogenized within this embodiment of the present invention. In addition, the composition may shift the wavelength of incident light, by both shortening and lengthening the wavelength of the incident light that is exposed to the composition.

The invention herein also relates to methods for creating an optically responsive yarn comprising the steps of extruding the composition of the above mentioned embodiments into a plurality of fibers and spinning those fibers into yarn. The present invention may consist of woven fibers comprising the aforementioned composition. In an alternative embodiment, the composition may also be woven with fibers comprising one or more additional natural fibers such as wool, cotton, silk, linen, hemp, ramie, and jute. In yet another embodiment, the composition may also include woven fibers comprising one or more synthetic fibers such as acrylic, acetate, lycra, spandex, polyester, nylon, and rayon. The present invention may also consist of non-woven fibers comprising the aforementioned composition. The non-woven fibers may be spun with woven natural fibers such as wool, cotton, silk, linen, hemp, ramie, and jute, or synthetic fibers such as acrylic, acetate, lycra, spandex, polyester, nylon, and rayon. The optically responsive yarn can be produced by these methods to create a fabric comprising either the woven or non-woven fibers of the aforementioned composition, spun together with a plurality of natural, synthetic or both natural and synthetic fibers.

Yet another embodiment of the present invention herein also relates to methods of retaining source radiation emitted from a subject or object comprising covering or surrounding an object bodily area with one of the above mentioned fabrics. In this embodiment, the fabric may be comprised of woven fibers consisting of the aforementioned composition. The composition spun with the woven fibers may be either natural or synthetic. The radiation may also be infrared radiation.

The present invention also relates to methods of retaining source radiation emitted from an object and may be achieved by covering or surrounding the object with one of the above mentioned fabrics.

DESCRIPTION OF THE PREFERRED EMBODIMENTS

It is understood that the present invention is not limited to the particular methodology, protocols, and reagents, etc., described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include plural reference unless the context clearly dictates otherwise.

Unless defined otherwise, all technical and scientific terms used herein have the same meanings as commonly understood by one of ordinary skill in the art to which this invention belongs. Preferred methods, devices, and materials are described, although any methods and materials similar or equivalent to those described herein can be used in the practice or testing of the present invention. All references cited herein are incorporated by reference in their entirety.

The present invention focuses on the creation of and methods of use of a biologically benign powder in a resin that has certain beneficial properties such as retaining source infrared radiation and changing the wavelength of light reflected by the powder or passing through the powder. This powder may be combined with a carrier material, such as a resin, specifically a polymer, and/or implemented into a textile fiber, a non-woven membrane, or a similar product. Products that incorporate this powder may provide additional beneficial properties to a subject wearing such a product such as, for example, wound healing, skin fibroblast stimulation, fibroblast growth and proliferation, increased DNA synthesis, increased protein synthesis, increased cell proliferation by changing the optical properties in and around the human system interacting with light, and changing the wavelength, reflecting, or absorbing light in the electromagnetic spectrum. The compositions and fibers of the present invention represent a combination of substances that work together with electromagnetic radiation to provide such beneficial properties.

Additionally, the compositions of the present invention may be used in a variety of settings to trap source infrared radiation, to provide heat to an object, or to prevent the escape of infrared light. Some uses may include, but are not limited to, insulation of heating and cooling systems, thermal insulation for outdoor recreation, retention of infrared light by military forces to prevent detection, and insulation of perishable items. Other uses of a fabric made from such a composition include hosiery, footwear, active wear, sports wear, sports wraps, base layer, gloves, and bandages. These items may also have certain properties such as controlling odor, regulating heat, providing protection from fire, providing protection from harmful light, insulation, wound healing, and preserving food.

Electromagnetic light spans a very large spectrum from 10 nm to 1060 nm of wavelength and spans ultraviolet light, visible light, and infrared light. Ultraviolet ("UV") light has wavelengths from 10 nm to 390 nm and is divided in to near (390 to 300 nm), mid (300 to 200 nm), and far (200 to 10 nm) spectra regions. Visible light is a small band in the electromagnetic spectrum with wavelengths between 390 and 770 nm and is divided into violet, blue, green, yellow, orange, and red light. Infrared ("IR") light spans from 770 nm to 1060 nm and includes near (770 to $1.5\times10^3$), mid ($1.5\times10^3$ to $6\times10^3$), and far ($6\times10^3$ to $10^6$) regions. The refractive index ("RI") is a measure of a substance's ability to bend light. Light and optical energy that the body is exposed to extends throughout the electromagnetic spectrum. The adult human body, at rest, emits about 100 watts of IR in the mid and far wavelengths. During exercise this level rises sharply and the distribution of wavelengths changes.

There are many types of materials that interact with optical energy by absorbing, reflecting, refracting, and/or changing the wavelength. When light is absorbed it is changed into molecular motion or heat, or optical energy of a longer wavelength. In one embodiment, the present invention relates to a material, such as a resin, film, polymer or fiber, for example, that is optically responsive to light and electromagnetic spectrums. The end materials created may be used to interact with living or non-living systems. The end material may be created by adding various active materials together to form a powder. The powder may then be combined or mixed with carrier materials that may have their own unique optical properties and may also act as a matrix for the powder and its particles.

The active materials selected to form the powder are selected based upon several characteristics. One characteristic is that the active materials, in particle form, may be biologically benign, or inert. The material preferably exhibits one of two optical properties: being transparent or having a different refractive index than the carrier material. Specific active materials that may be used in the present invention include silicon, carbon, and various vitreous glasses including oxides of aluminum, titanium, silicon, boron, calcium, sodium, and lithium. In a specific embodiment, the active materials are titanium dioxide, quartz, and aluminum oxide.

For example, the choice of materials and their optical properties can be selected to effect a certain result, such as, for example, a biological excitation for a range of wavelengths from 1.015 microns to 0.601 microns (601 nm). To target this area of light, an overlapping series of pass-bands that promote excitation and emission in the ranges that bracket the desired wavelength may be created by the materials. These pass bands may be created by using particles of staggered refractive indices with respect to the host, creating a known transparency and if possible concentrating normally blocked or attenuated wavelengths by using particles with high transparency and moderate refractive indices. Additionally, to ensure wide excitation, a material that is transparent to UV light with a high refractive index that is not transmissive at short wave, or harmful, UV regions may be used.

Specific carrier materials that may be used in the present invention include resins such as rayon, polyester (PET), nylon, acrylic, polyamide, and polyimide. For applications related to infrared light, solid transparent materials with a transmission in the range, of about 0.5 to about 11 microns is preferable, such as, for example, polyethylene and many of its derivatives, polypropylene and many of its derivatives, polymethylpentene, and polystyrene and many of its derivatives. These materials may also exhibit useful transparencies in the ultraviolet. The addition of active particles with varying refractive indices may yield a wide range of filtering effects in the IR and UV ranges. In particular, PET may serve as a medium to encase and act as a lensing medium for active materials.

Once the materials are selected, they may be ground or processed to comprise various properties. The grinding or processing helps to determine the particle size of the active material, the concentration of each type of active material, and the physical characteristics of the active material, and is known in the art. The physical characteristics may include the smoothness or shape of the particles. For example, the particles may be smooth, round, triangular, or scalloped.

The end material may achieve one of two results with respect to wavelength: it may shorten or lengthen wavelength depending the desired effect. In either use, IR light excites atomic and/or molecular structure. The excitation may frequently result in stresses on either atomic or molecular levels. When the stress is released, the electron energy level may change and release energy as photons.

In some combinations of carrier and active particle materials, particular wavelengths may be selected by the ease that a given wavelength may be absorbed and/or emitted. If the active particles are suspended in a matrix that performs a filtering action, i.e., passing optical energy, the active particles may be closer to the wavelength of the carrier material. Conversely, if shorter or longer wavelengths are to be passed, the size of the active particles may be closer to the size of the wavelength of the light passed. For example, in applications in which the desired wavelength is 1 micron, the particle size may be the same, i.e., 1 micron. If carrier material, such as PET for example, is capable of passing 14 micron to 4 microns it may be desirable to have some particles slightly larger than or equal to those wavelengths. Desired particles sizes may range from about 2 microns to about 0.5 micron and are preferably related to the targeted wavelength.

In a specific embodiment, the powder may comprise aluminum oxide ($Al_2O_3$), quartz ($SiO_2$), and titanium dioxide ($TiO_2$—in rutile form). Titanium dioxide may be obtained from any commercially available source, such as from Millennium Chemicals, Inc., Hunt Valley, Md. Quartz may be obtained from any commercially available source, such as Barbera Co., Alameda, Calif. Aluminum oxide may be obtained from any commercially available source, such as from Industrial Supply, Loveland, Colo.

Aluminum oxide has a unique property that promotes infrared light bandshifts under certain conditions. When aluminum oxide is combined with other materials, such as those described herein, interaction with IR light occurs. For example, the IR light emission of the human body is absorbed and excites electron energy levels in the atoms and molecules of the components of the compositions of the present invention. As the electrons return to their previous energy levels they release energy in the IR range but at a different wavelength, i.e., a longer Wavelength. The compositions of the present application, when used in a body covering, such as a compression wrap or sleeve, utilize these bandshifting properties of aluminum oxide to reflect longer infrared wavelengths back into the human body. The longer infrared wavelength, for example, allows capillaries to relax and be less constricted, resulting in greater blood flow where required, which results in improved body circulation.

Quartz, or silicon dioxide, is biologically benign if it is incorporated into a carrier material in solid bulk form. Quartz is also capable of non-linear frequency multiplication, and, in proper combination with a particular wavelength and a carrier, may emit ultraviolet (UV) light. UV light is known to inhibit bacterial growth and the creation of ozone. UV that has a wavelength that is too short can be detrimental to the human system. Quartz may be used to absorb the shorter wavelength UV light if its physical particle size is close to the wavelength of light that should be excluded. In the present invention, quartz may be used to increase frequency or shorten wavelength.

In addition to being optically active, quartz may exhibit piezoelectric properties. When quartz is stressed, the distribution of charges may become unequal and an electric field may be established along one face and an opposite field may be established along the other face. If the stressing effect, such as pressure, for example, is constant, the charges may redistribute themselves in an equal and neutral manner. If the stress is removed once the charges are redistributed, a charge of opposite polarity and equal magnitude to the initial charge may be established. This charge redistribution results in nonlinear behavior, which may be manifested as frequency doubling.

Titanium dioxide is unique because it has a high refractive index and also has a high degree of transparency in the visible region of the spectrum. It is used as a sunblock in sunscreens because it reflects, absorbs, and scatters light and does not irritate the skin. Only diamonds have a higher refractive index than titanium dioxide. For these reasons, titanium dioxide is ideal for applications that are close to skin surfaces.

If the optical properties of titanium are used in conjunction with quartz and an appropriate carrier material, such as PET, for example, a greenhouse effect may be created. Infrared wavelengths of one size may pass back through the PET and may be reflected. This reflection creates longer wavelengths that prevent passage back through the PET. In a specific embodiment of the present invention this property may be used to reflect longer wavelengths into the human system while directing shorter, more harmful wavelengths away from the human system.

Particle size and shape of the active materials in the powder may also affect the end product by controlling the wavelength of light that is allowed to pass through the particles. In a specific embodiment, a particle size of about 1.4 microns or smaller is used for aluminum oxide. The particle shape may be scalloped. The particle size of quartz may be about 1.5 microns or smaller. The quartz particles may be spherical or substantially spherical. The titanium dioxide particles may be about 2 microns or smaller and triangular with rounded edges.

The specific properties and characteristics of the active particles and carrier materials may be combined to produce a specific effect such as wound healing, skin fibroblast stimulation, fibroblast growth and proliferation, increased DNA synthesis, increased protein synthesis, and increased cell proliferation by changing the optical properties in and around the human system. These properties are related to specific wavelengths of light and the interaction of that light with the compositions of the present invention.

In one embodiment of the present invention wavelengths may be selected to provoke melanin excitement, which occurs at about 15 nm. To achieve this excitement an energy range from a band about 10 nm to about 2.5 microns from the human metabolic action may be used. Daylight from either an outdoor broadband or an indoor lamp ranges from about 1.1 microns, with a "hump" around 900 nm and a broad general peak around 700–800 nm, and also includes lesser wavelengths such as 400 to 700 nm. Some of the general properties and desirable filtering and changes include but are not limited to having band pass in the 600 to 900 nm band range. Also, a carrier material may be selected to have a transparency from 200–900 nm. PET has a known transparency in the 8 to 14 micron range. An active particle may also be selected to have a wavelength between about 950 and 550 nm. This may be accomplished by using particles with a general size distribution of 2 microns and lower.

Muscle and bone atrophy are well-documented in astronauts, and various minor injuries occurring in space have been reported not to heal until landing on Earth. Spectra taken from the wrist flexor muscles in the human forearm, and muscles in the calf of the leg, demonstrate that most of the light photons at wavelengths between 630–800 nm travel 23 cm through the surface tissue and muscle between input and exit at the photon detector. The light is absorbed by mitochondria where it stimulates energy metabolism in muscle and bone, as well as skin and subcutaneous tissue. Evidence suggests that using LED light therapy at 680, 730 and 880 nm simultaneously in conjunction with hyperbaric oxygen therapy accelerates the healing process in Space Station missions, where prolonged exposure to microgravity may otherwise retard healing. Tissues stimulate the basic energy processes in the mitochondria (energy compartments) of each cell, particularly when near-infrared light is used to activate the color sensitive chemicals (chromophores, cytochrome systems) inside each cell. Optimal LED wavelengths may include 680, 730, and 880 nm. Whelan et al., 552 SPACE TECH. & APP. INT'L FORUM 35—35 (2001). Whelan et al., 458 SPACE TECH. & APP. INT'L FORUM 3–15 (1999). Whelan et al., 504 SPACE TECH. & APP. INT'L FORUM 37–43 (2000). Near-infrared light at wavelengths of 680, 730 and 880 nm stimulate wound healing in laboratory animals, and near-infrared light has been shown to quintuple the growth of fibroblasts and muscle cells in tissue culture. Hence, the particle size of the compositions of the present invention may be selected to provide reflective or pass through beneficial wavelengths of light.

The active particles of the present invention may be ground to reach an approximate particle size of about 0.5 to about 2.0 microns. For example, titanium dioxide may be ground to a grain size of between 1 and 2 microns and may be triangular with rounded edges. Aluminum oxide may be ground to a grain size of between 1.4 and 1 microns and may be scalloped-shaped. Quartz is preferably ground to a grain size of about 1.5 to 1 microns and is generally rounded. All particles are reduced in size and shaped by processes known in the art, such as grinding, polishing, or tumbling, for example. In a preferred embodiment, the dry weight ratio of the active materials titanium dioxide, quartz, and aluminum oxide in the powder is 10:10:2, respectively.

In a specific embodiment of the present invention, the compositions may further comprise a resin, such as a polymer made into a film or fiber. The polymer may initially be in pellet form and dried to remove moisture by using, for example, a desiccant dryer. The powder may then be dispersed into the resin by methods known in the art, such as for example in a rotating drum with paddle-type mixers. In one embodiment of the present invention the polymer used may be polyester. The powder may comprise from about 0.5 to about 20 percent of the mixture. In another embodiment, the powder may comprise from about 1 to about 10 percent of the mixture. In a specific embodiment, the powder may comprise from about 1 to about 2 percent of the total weight of the resin/powder mixture. To produce one half ton of fiber, about 100 pounds of the powder may be combined with about 1000 pounds of PET. In an alternative embodiment, the powder may be introduced to the resin by other processes known in the art such as compounding, for example. In this embodiment, 100 pounds of the powder may be combined with about 250 to about 300 pounds of PET.

After the resin and powder are combined, the resulting liquid may be extruded into fiber that may be drawn into staple fibers of various lengths. This process of grinding, combining, and extrusion is known in the art, as described in, for example, U.S. Pat. Nos. 6,204,317; 6,214,264; and 6,218,007, which are expressly incorporated by reference in their entirety herein.

The basic techniques for forming polyester fiber by extrusion from commercially available raw materials are well known to those of ordinary skill in this art and will not otherwise be repeated herein. Such conventional techniques are quite suitable for forming the fiber of the invention and are described in U.S. Pat. No. 6,067,785, which is herein expressly incorporated by reference in its entirety.

After extrusion the fibers may be combined together by a spinning process, preferably using a rotary spinning machine, to yield a yarn. The range of the size of the apertures in the rotary spinning machine may be from about 6 microns to about 30 microns.

In preferred embodiments, the step of spinning the fibers of the present invention into yarn comprises spinning staple having a denier per fiber of between about 1 and about 3; accordingly, the prior step of spinning the melted polyester into fiber likewise comprises forming a fiber of those dimensions. The fiber is typically heat set before being cut into staple with conventional techniques. While the extruded fibers are solidifying, they may be drawn by methods known in the art to impart strength.

Similarly, the method can further comprise forming fabrics, typically woven or knitted fabrics from the spun yarn in combination with both natural and synthetic fibers. Typical natural fibers may include cotton, wool, hemp, silk, ramie, and jute. Alternatively, typical synthetic fibers may include acrylic, acetate, Lycra, spandex, polyester, nylon, and rayon.

Because polyester is so often advantageously blended with cotton and other fibers, the present invention also includes spinning a blend of cotton into yarn in which the polyester may include between about 0.5 and 4% by weight of polyethylene glycol into yarn in a rotor spinning machine.

The method can further comprise spinning the fibers of the present invention. Similarly, the fibers of the present invention may include a woven or knitted fabric from the blended yarn with the yarn being either dyed as spun yarn, or after incorporation into the fabric in which case it is dyed as a fabric.

The cotton and polyester can be blended in any appropriate proportion, but in the specific embodiments the blend includes between about 35 and 65% by weight of cotton with the remainder polyester. Blends of 50% cotton and 50% polyester ("50/50") are also used.

The yarn formed according to this embodiment can likewise be incorporated into blends with cotton, and is known to those familiar with such blending processes, the cotton is typically blended with polyester staple fiber before spinning the blend into yarn. As set forth above, the blend may contain between about 35% and 65% by weight cotton with 50/50 blends being typical. Other methods of production of fibers are equally suitable such as those described in U.S. Pat. Nos. 3,341,512; 3,377,129; 4,666,454; 4,975,233; 5,008,230; 5,091,504; 5,135,697; 5,272,246; 4,270,913; 4,384,450; 4,466,237; 4,113,794; and 5,694,754, all of which are expressly incorporated by reference in their entirety herein.

In one embodiment of the present invention, the polyester mixture may be used to create a staple fiber. The staple fiber may then be used to create a non-woven membrane. This membrane may be bonded to another fabric, membrane or material. For example, the non-woven membrane may be used as a lining by being bonded to the inside of a pair of leather gloves or, for example, being bonded to another fabric such as Thinsulate™ by 3M by methods known to those skilled in the art.

EXAMPLES

Without further elaboration, it is believed that one skilled in the art, using the preceding description, can utilize the present invention to the fullest extent. The following examples are illustrative only, and not limiting of the remainder of the disclosure in any way whatsoever.

Example 1

Thermal Homeostasis

Two batches of wrist bands are prepared: WB1 (woven with fibers comprising the powder composition of the present invention) and WB2 (woven with fibers lacking the powder composition of the present invention).

Twenty panelists are selected from the general population, and no specific demographic parameters are utilized in recruiting the panelists. Panelists are placed within a climate-controlled area of standard room temperature, standard humidity, and sea-level atmospheric pressure. A measurement of each panelist's middle finger temperature is taken prior to the panelists' donning of any band. Panelists are asked to don a band from WB2. Five minutes later, a measurement of each panelist's middle finger temperature is taken. Panelists are then asked to remove the band from WB2, wait five minutes, and don a band from WB1. Five minutes later, measurements of each panelist's middle finger temperature are taken. Thermographic instruments are used to record the temperatures of the fingers of the panelists throughout the trials. All temperature measurements are averaged.

There exists a statistically significant difference between the average middle finger temperature of the panelists after their donning of bands from WB1 and the average middle finger temperature of the panelists prior to their donning of any band. Further, there exists no statistically significant difference between the average middle finger temperature of the panelists after their donning of bands from WB2 and the average middle finger temperature of the panelists prior to their donning of any band. The ability of the bands woven with fibers comprising the powder composition of the present invention to serve as agents of thermal homeostasis is demonstrated.

Example 2

Muscle Strength

Two batches of wrist bands are prepared: WB1 (woven with fibers comprising the powder composition of the present invention) and WB2 (woven with fibers lacking the powder composition of the present invention).

Panelists are selected from the general population, and no specific demographic parameters are utilized in recruiting the panelists. Panelists are placed within a climate-controlled area of standard room temperature, standard humidity, and sea-level atmospheric pressure. A measurement of each panelist's grip strength is taken prior to the panelists' donning of any band. Panelists are asked to don a band from WB2. Five minutes later, a measurement of each panelist's grip strength is taken. Panelists are then asked to remove the band from WB2, wait five minutes, and don a band from WB1. Five minutes later, measurements of each panelist's grip strength are taken. Grip dynamometers are used to record the grip strengths of the panelists throughout the trials. All grip strength measurements are averaged.

There exists a statistically significant difference between the average grip strength of the panelists after their donning of bands from WB1 and the average grip strength of the panelists prior to their donning of any band. Further, there exists no statistically significant difference between the average grip strength of the panelists after their donning of bands from WB2 and the average middle finger temperature of the panelists prior to their donning of any band. The ability of the bands woven with fibers comprising the powder composition of the present invention to increase muscle strength is demonstrated.

Example 3

Insoles

The powder composition of the present invention is prepared by the processes of the present invention. Two batches of insoles are prepared: IN1 (woven with fibers comprising the powder composition of the present invention) and IN2 (woven with fibers lacking the powder composition of the present invention).

Panelists are selected from the general population, and no specific demographic parameters are utilized in recruiting the panelists. Samples, are presented to panelists in a blinded manner (samples are identified only by a random digit label). Each panelist receives two insoles to wear, one within each shoe, and panelists are instructed to randomly place one insole within each shoe. Thus, the shoe (right or left) in which each insole is worn is completely random. In each pair of insoles, one sample is from IN1 and one sample is from IN2. Panelists are asked to record any differences between the two insoles that they notice after wearing them for an eight hour period.

A number of the panelists note a difference between the insoles. A statistically significant number of those panelists noting a difference between the two insoles regard the insole comprising the powder composition of the present invention as providing greater comfort than the insole lacking the powder composition of the present invention. The ability of the insoles woven with the fibers comprising the powder composition of the present invention to provide comfort is demonstrated.

Various modifications and variations of the described methods and systems of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are obvious to those skilled in materials engineering or related fields are intended to be within the scope of the following claims.

We claim:

1. An active material system, comprising:

optically active particles responsive to light due to an interaction of electromagnetic energy and electric fields; and a carrier material combined with the optically active particles for retaining the particles and forming an end material;

wherein when the electromagnetic energy and the electric fields interact with the end material, the end material absorbs light of a particular wavelength, re-emits the light at different selected wavelengths and attenuates the light differently at different wavelengths to produce a filter with a desired wavelength distribution.

2. The active material system as recited in claim 1, wherein the optically active particles comprise a plurality of different particle types, the different particle types having staggered refractive indices with respect to each other to generate an overlapping series of passbands that encompass the desired wavelength distribution.

3. The active material system as recited in claim 2, wherein each of the different particle types are reduced to a particular size and shape to generate a particular wavelength passband.

4. The active material system as recited in claim 3, wherein the size of the optically active particles is approximately the size of the wavelength of the light to be passed.

5. The active material system as recited in claim 1, the optically active particles comprising:

aluminum oxide for bandshifting the wavelengths of received light;

silicon dioxide for shortening the wavelengths of the received light; and titanium dioxide for reflecting, absorbing and scattering the received light.

6. The active material system as recited in claim 5, the aluminum oxide being reduced in size to scallop shaped particles of about 1.4 microns or smaller.

7. The active material system as recited in claim 5, the silicon dioxide being reduced in size to substantially spherical shaped particles of about 1.5 microns or smaller.

8. The active material system as recited in claim 5, the titanium dioxide being reduced in size to triangular shaped particles with rounded edges of about 2 microns or smaller.

9. The active material system as recited in claim 5, the titanium dioxide, silicon dioxide and aluminum oxide having a dry weight ratio of about 10:10:2, respectively.

10. The active material system as recited in claim 5, the titanium dioxide, silicon dioxide and aluminum oxide comprising about 1–2% of a total weight of the active material system.

11. The active material system as recited in claim 1, the carrier material for encasing and acting as a lensing medium for the optically active particles.

12. The active material system as recited in claim 1, wherein the active material forms a fiber usable in textiles.

13. A method of making an end material that alters the wavelength of received light, comprising:

selecting optically active particles responsive to light due to an interaction of electromagnetic energy and electric fields; and suspending the selected optically active particles in a carrier material to form the end material;

wherein when the electromagnetic energy and the electric fields interact with the end material, the end material absorbs light of a particular wavelength, re-emits the light at different selected wavelengths and attenuates the light differently at different wavelengths to produce a filter with a desired wavelength distribution.

14. The method as recited in claim 13, further comprising selecting the particles to comprise a plurality of different particle types, the different particle types having staggered refractive indices for generating an overlapping series of passbands that encompass the desired wavelength distribution.

15. The method as recited in claim 14, further comprising reducing each of the different particle types to a particular size and shape to generate a particular wavelength passband.

16. The method as recited in claim 14, further comprising reducing the optically active particles to a size that is approximately a size of the wavelength of the light to be passed by those particles.

17. The method as recited in claim 13, further comprising selecting aluminum oxide for bandshifting the wavelengths of received light, silicon dioxide for shortening the wavelengths of the received light, and titanium dioxide for reflecting, absorbing and scattering the received light.

18. The method as recited in claim 17, further comprising reducing the aluminum oxide to scallop shaped particles of about 1.4 microns or smaller.

19. The method as recited in claim 17, further comprising reducing the silicon dioxide to substantially spherical shaped particles of about 1.5 microns or smaller.

20. The method as recited in claim 17, further comprising reducing the titanium dioxide to triangular shaped particles with rounded edges of about 2 microns or smaller.

21. The method as recited in claim 17, further comprising utilizing quantities of the titanium dioxide, silicon dioxide and aluminum oxide in a dry weight ratio of about 10:10:2, respectively.

22. The method as recited in claim 17, further comprising utilizing quantities of the titanium dioxide, silicon dioxide and aluminum oxide to comprise about 1–2% of a total weight of the fiber.

23. The method as recited in claim 13, further comprising encasing the optically active particles in the carrier material and acting as a lensing medium for the optically active particles.

24. The method as recited in claim 13, further comprising forming the end material to make textiles.

25. An active material system, comprising:

optically active means responsive to light due to an interaction of electromagnetic energy and electric fields; and carrier means combined with the optically active particles for retaining the particles and forming an end material;

wherein when the electromagnetic energy and the electric fields interact with the end material, the end material absorbs light of a particular wavelength, re-emits the light at different selected wavelengths and attenuates the light differently at different wavelengths to produce a filter with a desired wavelength distribution.

26. The active material system as recited in claim 25, the optically active means comprising a plurality of different particle types, the different particle types having staggered refractive indices with respect to each other for generating an overlapping series of passbands that encompass the desired wavelength distribution.

27. The active material system as recited in claim 26, wherein each of the different particle types are reduced in size to a particular size and shape to generate a particular wavelength passband.

28. The active material system as recited in claim 27, the optically active means reduced to approximately a size of the wavelength of the light to be passed by those means.

* * * * *